United States Patent [19]

Takagi

[11] Patent Number: 5,058,639

[45] Date of Patent: Oct. 22, 1991

[54] METHOD FOR APPLYING PRESSURE TO A DRIVING ROLLER FOR A VENEER LATHE

[75] Inventor: Yukio Takagi, Obu, Japan

[73] Assignee: 501 Meinan Machinery Works, Inc., Obu, Japan

[21] Appl. No.: 612,024

[22] Filed: Nov. 13, 1990

[30] Foreign Application Priority Data

Nov. 15, 1989 [JP] Japan ..... 1-297000

[51] Int. Cl.[5] ..... B27L 5/02

[52] U.S. Cl. ..... 144/357; 144/213; 144/365

[58] Field of Search ..... 144/209 R, 211, 212, 144/213, 357, 365

[56] References Cited

U.S. PATENT DOCUMENTS

| | | | |
|---|---|---|---|
| 4,061,169 | 12/1977 | Hasegawa | 144/213 |
| 4,262,716 | 4/1981 | Hasegawa | 144/213 |
| 4,380,259 | 4/1983 | Brookhyser et al. | 144/213 |
| 4,901,777 | 2/1990 | Koike | 144/213 |

FOREIGN PATENT DOCUMENTS

| | | |
|---|---|---|
| 56-16729 | 4/1981 | Japan . |
| 58-51104 | 3/1983 | Japan . |
| 59-19007 | 5/1984 | Japan . |
| 59-28444 | 7/1984 | Japan . |
| 61-21808 | 5/1986 | Japan . |

*Primary Examiner*—W. Donald Bray
*Attorney, Agent, or Firm*—Pennie & Edmonds

[57] ABSTRACT

Pressure is applied at a plurality of locations to the driving roller of a peripheral driving veneer lathe. The pressure at each location is selectively and independently controlled to achieve a desired degree of engagement by the driving roller over the surface of a bolt to be lathed.

29 Claims, 6 Drawing Sheets

METHOD FOR APPLYING PRESSURE TO A DRIVING ROLLER FOR A VENEER LATHE

FIELD OF THE INVENTION

The present invention relates to a veneer lathe, and more particularly to an improvement of the method for applying pressure to a driving roller for a peripheral driving veneer lathe.

BACKGROUND OF THE INVENTION

In recent years, as disclosed for example in the Japanese patent publications filed by this applicant and entitled "Veneer Lathe" (Japanese Patent Publication No. 116729/1981), "Veneer Lathe" (Japanese Patent Publication No. 19007/1984), and "Peripheral Driving Veneer Lathe" (Japanese Patent Publication No. 28444/1984), there is in practical use a peripheral driving veneer lathe comprising a driving roller which can be engaged with the periphery of a bolt immediately before lathing and having a structure whereby at least part of the driving force required for lathing the bolt can be supplied to the bolt at its periphery through said driving roller. With this type of veneer lathe, it becomes possible to prevent or significantly reduce problems such as breakage of the bolt, and stuffing of material at the tip of the cutting tool, both of which tend to occur in a conventional veneer lathe where the driving force is supplied to the axial duramen of the bolt exclusively through the spindles. Thus it becomes easier to handle low quality bolts, the use of which has been avoided in lathing hitherto.

Furthermore, as disclosed, for example, in "Veneer Lathe" (Japanese Patent Publication No. 21808/1986) a technique is developed to stabilize the engagement degree of a driving roller with a bolt in such a manner thqt the driving roller is displaced following the changes in the diameter of a bolt. However, even an improvement such as this in the technique is insufficient to deal appropriately with the different properties from one bolt to another, or the difference in hardness of a bolt at its alburnum and axial duramen part.

Yet another technique attempts to optimize the degree of engagement by providing a plurality of driving rollers at specific places in such a fashion that the driving rollers are pressurized by a uniform selected pressure in the centripetal direction, said pressure being adjusted in accordance with the overall characteristics of a bolt. A mechanism according to this technique was proposed in the previous application "Peripheral Driving Veneer Lathe" (Utility model application No. 54847/1989). The mechanism simply increases or decreases the pressure applied to each of the driving rollers uniformly at a plurality of specific places. A disadvantage which occasionally is encountered with the mechanism is that the engagement degree of the driving roller with the bolt deviates.

From the viewpoint of simplifying the system as a whole including the apparatus and devices required for its driving, it is desirable to form a single roller with an engagement length corresponding to the maximum length of a bolt according to specification, and apply pressure in a state where the driving roller is held only at two places at both ends thereof. However, even if the pressures are applied equally at said two places in operating such system, the engagement degree of the driving roller with the bolt deviates when the holding position for the bolt is imbalanced toward either one of the two ends as, for example, in the case of using a four foot veneer lathe for lathing a three foot bolt set with its end aligned with an end of the lathe.

Also, in practice, the driving roller must be arranged in the vicinity of the tip of the tool, and the size of the driving roller that can be mounted is limited. Consequently, the rigidity of the driving roller is also limited. As a result, where a single driving roller is pressurized only at two places at both ends thereof, a deflection tends to occur in the middle section between them. Therefore, in order to equalize the engagement degree of the driving roller with the bolt when lathing a long bolt within a practicably allowable limit, it is desirable to either apply pressures at appropriate places in the middle section in addition to the two places at both ends of the single roller, or to divide the driving roller into plural rollers, with each of the small rollers pressurized at its appropriate places. In the latter case, it is still desirable to make the number of the divided rollers as small as possible from the viewpoint of simplifying the system.

In the configuration mentioned above, the engagement degree of the driving roller with the bolt deviates if the holding position of the bolt is lopsided as in the previous case. Furthermore, even if a bolt is held with the center of a veneer lathe as its reference point to keep the balance of the holding positions for the bolt, deviation in the engagement degree still occurs when the length of the bolt changes as, for example, in the case of lathing a six foot bolt by an eight foot veneer lathe with the center thereof as the reference point for holding.

In this connection, when a longest standard bolt is lathed using a single roller with pressures applied at three places, two at both ends and one in the middle, the desirable pressure ratio at each pressurized place is approximately 1:10/3:1. In a different example in which a driving roller is divided into two parts at its center and pressurized at four places, two at both ends and two at the central parts, for example, the desirable pressure ratio is 1:1:1:1. Whatever the case may be, it is readily understandable that if a bolt shorter than the longest bolt that can be lathed is set on the basis of such ratio, the engagement degree in the vicinity of both ends of said bolt becomes relatively excessive as compared with that in the central part thereof.

The aforementioned prior art publications also disclose a driving roller comprising many spiky members mounted on its periphery, which are impaled into a bolt for engagement. This is more practicable because it is more capable of transferring the driving force as compared with a driving roller whose periphery is smooth. However, depending on the hardness of a bolt, the impaling degree of the spiky members differs, absent any modification. Hence, if this driving roller is used for lathing a bolt having hard knots locally concentrated, such as pine and the like, the engagement degree may deviate from one point to another.

The various deviations of the engagement degree such as set forth above lead to the inferior quality of a veneer as a finished product or other problems such as the breakage of a bolt. It is desired to prevent or reduce such deviation.

The purpose of the present invention, therefore, is to obtain a pressure method for preventing or reducing the deviation of the engagement degree of a driving roller with a bolt by adjustment of the pressure ratio at the plural places where the pressures are applied to the driving roller for a peripheral driving veneer lathe, so that the various adverse effects detailed above can be reduced.

SUMMARY OF THE INVENTION

The present invention has been made with a view to solving the above-mentioned problems. More particularly, there is proposed a pressure method wherein the ratio of the pressures applied to a driving roller at various places is adjusted in accordance with lathing conditions such as the length, holding position, and hardness of a bolt by providing a single or divided driving roller structured in such a fashion that at each of the specific plural places thereof, a pressure can be selectively and independently applied in the centripetal direction of the bolt.

In this respect, according to the present invention, the pressure ratio is adjusted at the plural places when the pressures are applied to the driving roller. Hence the specific strength of each pressure, i.e., the absolute value of each pressure, can be selected appropriately in accordance with the properties of a bolt as a whole. If required, this method can also be adopted in combination with a pressure method whereby the absolute value of each pressure is increased or decreased gradually or continuously in accordance with the properties of the bolt as a whole while adjusting and maintaining the pressure ratio as desired.

Also, a preferred pressure ratio in the embodiment which will be described later is calculated on the assumption that the rigidity of the bolt is higher than that of the driving roller and is almost uniform in the longitudinal direction. Therefore, an appropriate correction should be made in the case of the rigidity of the bolt becoming equal to or lower than that of the driving roller, for example due to thinning of the bolt duramen. Similarly, adjustment would be made in the case of uneven rigidity of the bolt in the longitudinal direction resulting from the holding manner which requires part of the spindle to be inserted into the center hole provided in the axial duramen of the bolt as disclosed, for example, in "Method for Cutting a Bolt in a Veneer Lathe" (Japanese Laid-open patent No. 51104/1983). However, the pressure ratio is not necessarily adjusted to an extreme precision. It suffices if the deviation of the engagement degree of the driving roller with a bolt can be adjusted just to the extent that there is no problem in practice, and if required, a known backup mechanism can be installed separately to prevent the deflection of the bolt. In that case the adverse effect caused by the deflection of the bolt is prevented or reduced, while at the same time there is no need of any correction as set forth above.

The length and holding position of a bolt are usually determined by the width of a single board and its subsequent process of manufacturing, and the desirable pressure ratio at each place can be calculated in advance with a formula established for defining deflection. Therefore, it is convenient and possible to form a structure for automatically adjusting the pressure ratio by, for example, providing a position detector for detecting the distance between a pair of the spindles at the right and left hand sides (projected length) to hold a bolt for determining the length and holding position thereof, and a controlling means for converting electrically or mechanically the movement of a pressure control valve etc. in accordance with the detected signals from said position detector for adjusting the hydraulic pressure introduced into said pressure mechanism on the basis of the predetermined value of the ratio.

On the other hand, the appearance of locally concentrated knots is not always predictable. Therefore, the adjustment according to the difference in hardness of different parts of the bolt cannot be automated immediately. However, if required, it is possible to automatically carry out the adjustment by, for example, providing a hardness detector comprising a plurality of detecting rollers with many spiky members mounted on the periphery thereof which are installed at appropriate intervals in the axial direction of a bolt in such a manner that each of them is in contact with the periphery of the bolt independently. Based on the impaling depth of said spiky members, the hardness of each different part of the bolt is defined, the detected signals from said hardness detector are utilized for the automatic adjustment after the bolt becomes cylindrical.

The automated system set forth above has a disadvantage in that it cannot be achieved without a complicated system and operation, as well as higher cost, whereas the length and holding position of a bolt can be measured by, for example, visual estimation by an operator. Based on the predetermined desired ratio, adjustments can be made semi-automatically or manually without any particular hindrance in practice. The appearance of the concentrated knots can also be identified visually or the deviation of the engagement degree of the driving roller with the bolt can be estimated by visual estimation of the curb, bend, split, or flow caused by the pressure of the driving roller and other factors. Hence, automation is not necessarily required.

Also, in general, the quality of a bolt is roughly divided into a comparatively hard alburnum and a comparatively soft duramen, and usually, each part has a different moisture content and/or color. It is therefore convenient to detect the moisture content and/or color by a detector or observe them visually for determining the different hardnesses of the bolt as a whole when a method of increasing or decreasing the absolute value gradually or continuously is used.

DESCRIPTION OF THE PREFERRED EMBODIMENTS

With reference to the embodiments shown in the accompanying drawings, the present invention will subsequently be described in more detail.

Figure 1:
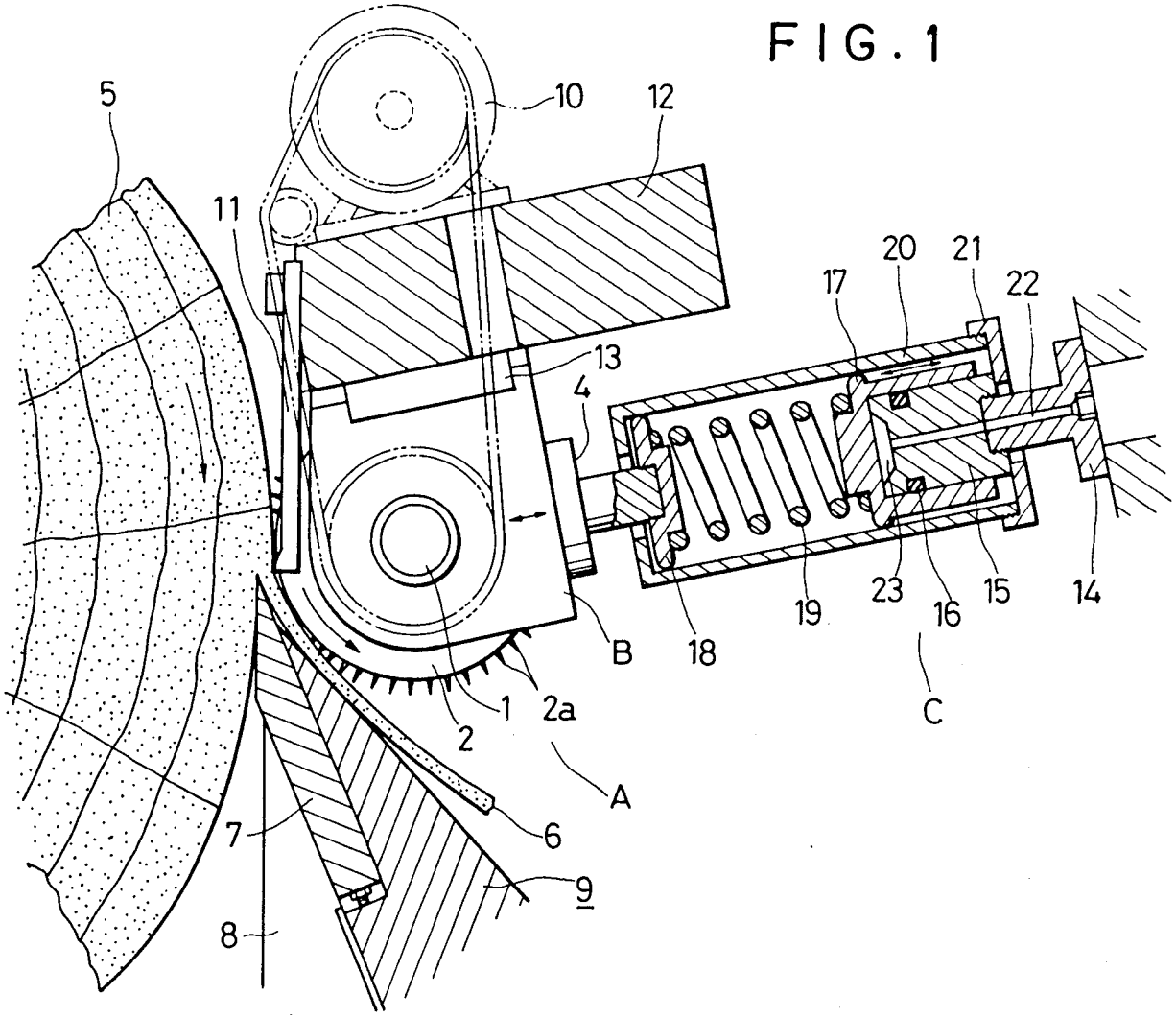
FIG. 1 is a sectional side view illustrating a peripheral driving veneer lathe employed in a first embodiment of the present invention.
Figure 2:
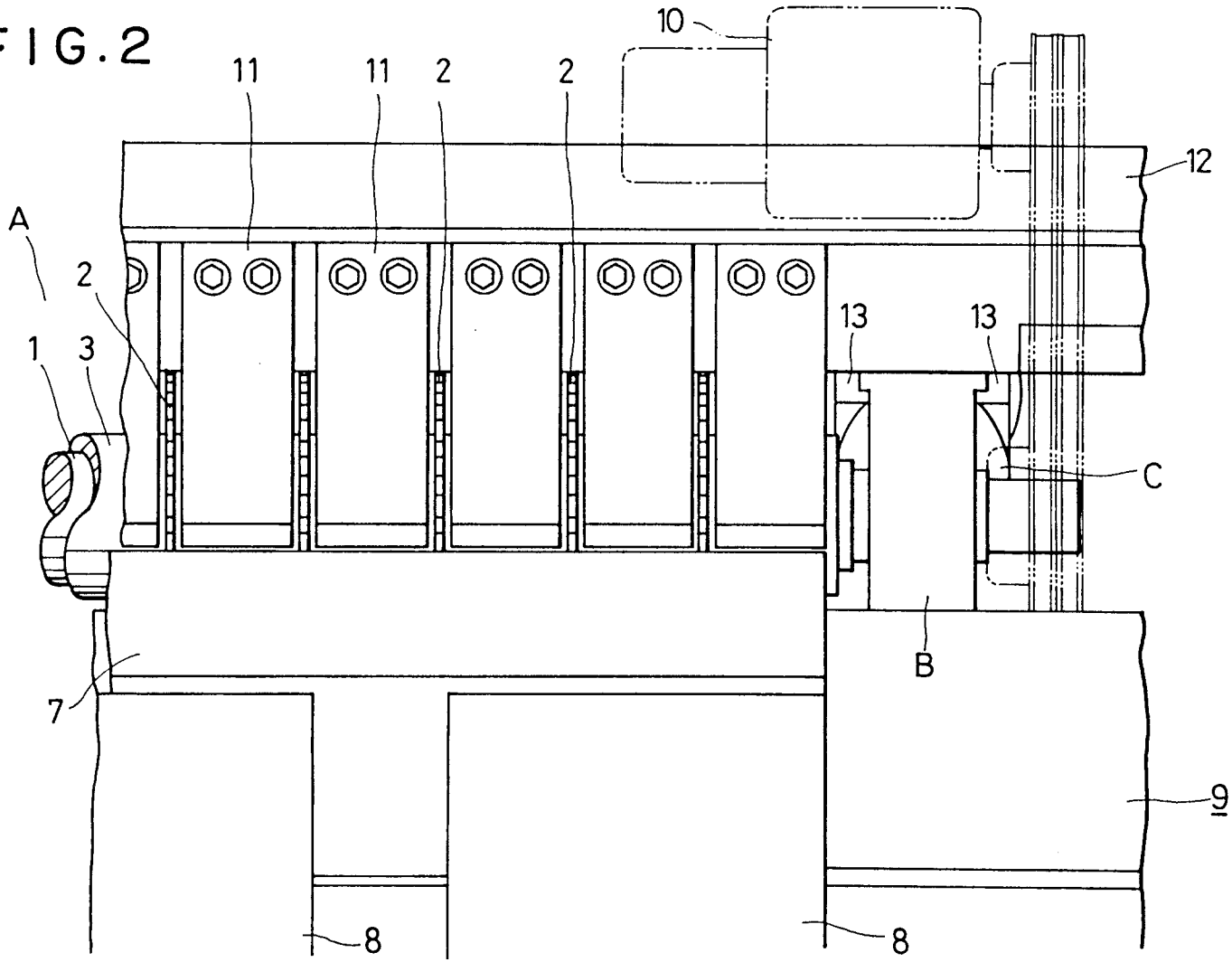
FIG. 2 is a partial elevation illustrating the peripheral driving veneer lathe of FIG. 1.

In the figures, a mark A denotes a single or divided driving roller having a plurality of driving members 2 of circular saw type with many spiky members 2*a* on their periphery and a plurality of spacer rings 3 of an appropriate width which are fittingly mounted alternately on a shaft 1 and are fixedly clamped in the axial direction by clamping nuts (not shown) (preferably together with means for stopping rotational movement such as keys), being provided through a bearing B at a position where said spiky members *2a* can impale the periphery of a bolt immediately before lathing. In the embodiment of FIG. 1, this position is the place where the periphery of the bolt 5, immediately before the tip of a cutting tool 7 fixedly clamped by a clamp 8 on a knife stock 9, and a veneer 6 immediately after cutting, can both be impaled. The roller is driven in the direction indicated by an arrow shown in the figure by the driving motion from a driving source 10 comprising an electric motor with a speed reducer, so that at least part of the driving force required for lathing the bolt 5 can be supplied to the periphery of the bolt immediately before lathing.

A plurality of bearings are shown at B, including an automatic self-aligning bearing for holding the shaft 1 of driving roller A rotatably, being slidably shuttled in a direction indicated by an arrow in the figure by the guiding function of a guide 13 mounted on the holder 12 of a depressor 11 for depressing the boundary of the bolt 5 and the veneer 6, so that said driving roller A is guided in the centripetal direction of the bolt and the centrifugal direction thereof.

A plurality of pressure mechanisms are shown at C, comprising a guide rod 15 held by a holder 14, a sliding cover 17 which also functions as a washer fitted slidably in said guide rod 15, a washer 18 which sandwiches a coil spring 19 under pressure in cooperation with said sliding cover 17 and a pair of expansion regulators 20 and 21 which are arranged to be in contact with each of said washer 18 and said guide rod 15 in the outer face, being connected respectively to each of said bearings B through a connecting pin 4, so that said driving roller A is pressed by the resiliency of the coil spring 19 in the centripetal direction at a plurality of specific places.

Furthermore, said pressure mechanism C can adjust the hydraulic pressure, such as oil, introduced into an internal chamber 23 closed up by an O ring 16 through an induction hole 22 provided in the holder 14 and the guide rod 15, setting up a desired pressure (proportional to the spring constant of the coil spring) independently by increasing or decreasing the initial deformation of the coil spring 19 by moving the sliding guide cover 17. At the same time, by adjusting the relative position of the pair of expansion regulators 20 and 21, the expansion of the coil spring 19 can be regulated through the washer 18 and the guide rod 15. Hence it is possible to regulate the position and degree of engagement of the driving roller A to the bolt 5 (and the single board 6).

According to the present invention, the pressure ratio can be independently adjusted at each point where pressure is applied to a peripheral driving veneer lathe, in accordance with a lathing condition when the driving roller is pressurized in the centripetal direction of the bolt.

Figure 3:
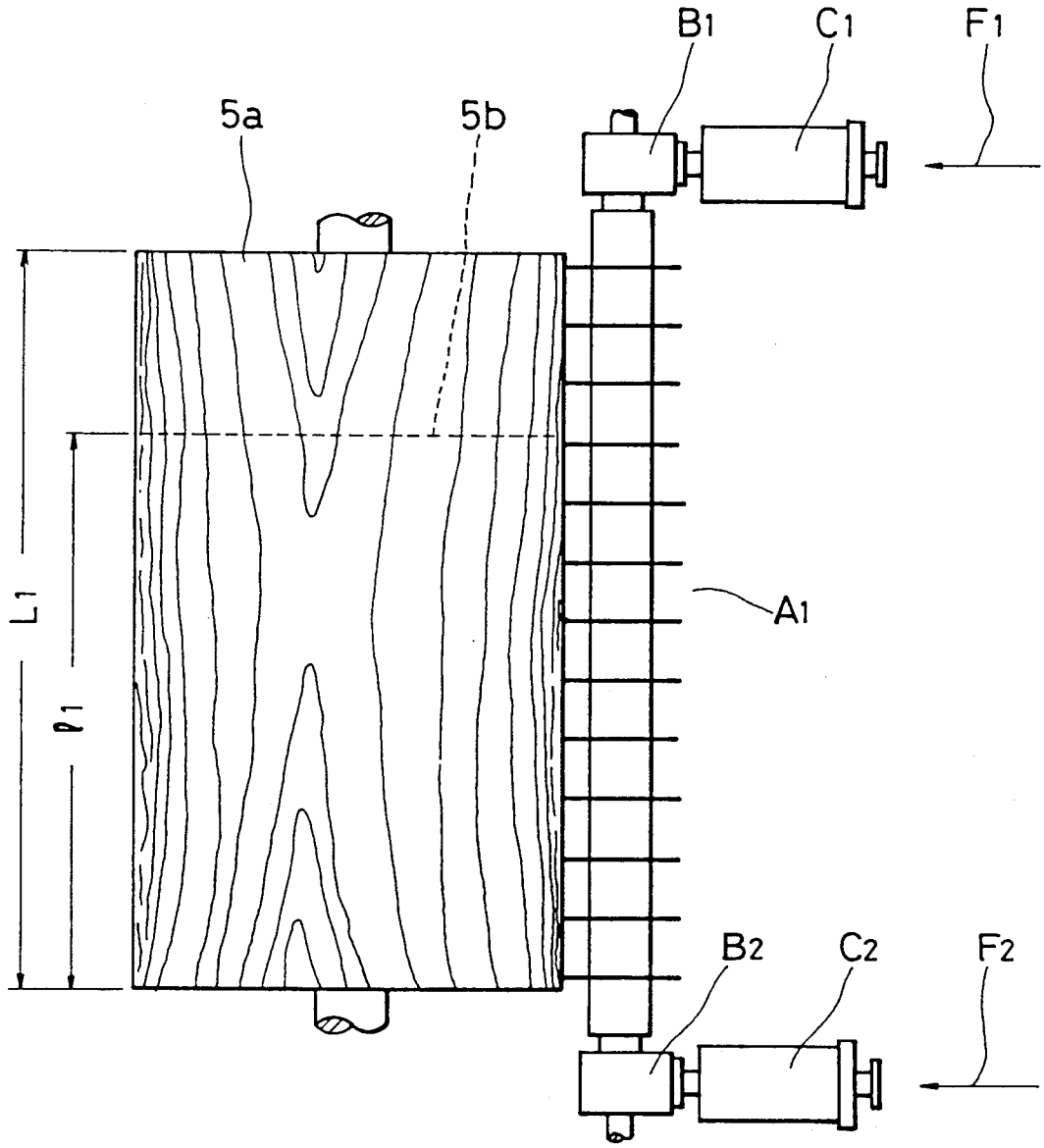
FIG. 3 is a plan view illustrating a first state in which pressure is applied to the driving roller.

For example, as shown in FIG. 3, when a single driving roller $A_1$ having an engagement length $L_1$, which corresponds to that of a bolt *5a* of a maximum length, is held by each of the bearings $B_1$ and $B_2$ at both ends of the driving roller, and pressurized in the centripetal direction by each of the pressure mechanisms $C_1$ and $C_2$ which are respectively connected to the bearings $B_1$ and $B_2$, it is desirable to define the ratio between the pressures $F_1$ and $F_2$ of said pressure mechanisms $C_1$ and $C_2$ to be 1:1 if the object is the bolt *5a* having the maximum length. However, if a bolt *5b* of a length $l_1$ is held with the bearing $B_2$ side as its reference face under said lathing conditions without any changes, the engagement degree becomes relatively excessive in the area toward the bearing $B_1$ as compared with the area toward the bearing $B_2$.

Thus, the pressure method according to the present invention is designed to adjust the ratio between the pressures $F_1$ and $F_2$ respectively of the pressure mechanisms $C_1$ and $C_2$ in accordance with said lathing conditions, and in this respect, with a formula to work out a beam deflection as a reference, the ratio between $F_1$ and $F_2$ can desirably be set as $l_1/L_1$:2-($l_1/L_1$) in said embodiment.

Figure 4:
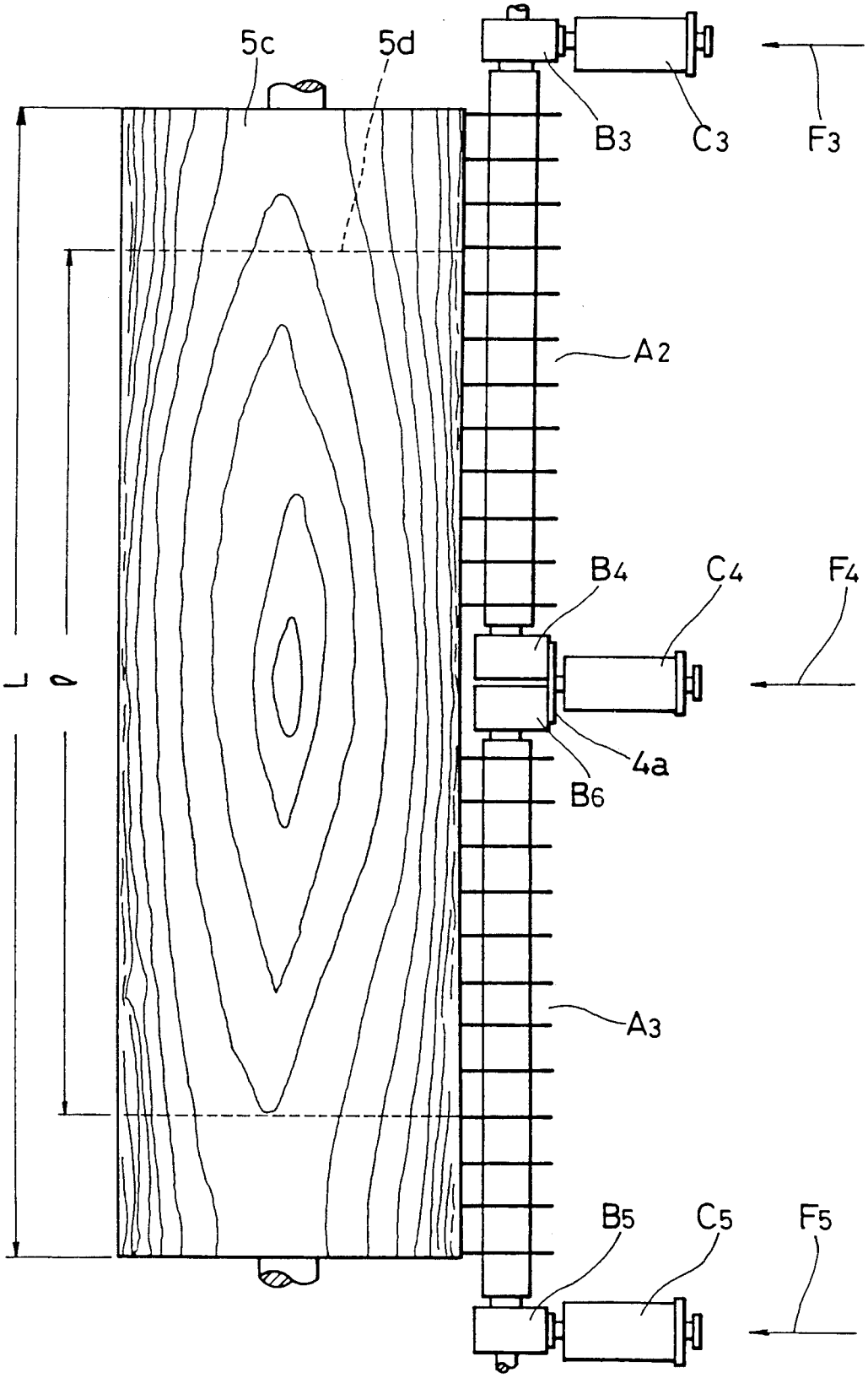
FIG. 4 is a plan view illustrating a second state in which pressure is applied to the driving roller.

FIG. 4 shows an embodiment which comprises the driving rollers $A_2$ and $A_3$ which are divided into those two parts at the center and held respectively by bearings $B_3$ and $B_5$ at two places, both ends of the entire body, and also by bearings $B_4$ and $B_6$ at two places in the central part, and at the same time, pressure mechanisms $C_3$ and $C_5$ respectively connected to the bearings $B_3$ and $B_5$ at both ends, and a pressure mechanism $C_4$ (the spring constant can freely be modified as required) connected to the bearings $B_4$ and $B_6$ at the central part through a wide connecting pin *4a*, and in which the pressure is applied in the centripetal direction of a bolt. In the case of a bolt *5c* of a maximum length having a length L as an object for lathing, it is desirable to define the pressure ratio between the pressures $F_3$, $F_4$, and $F_5$ respectively of the pressure mechanisms $C_3$, $C_4$, and $C_5$ as 1:2:1. However, if, for example, a bolt *5d* having a length l is held as an object with the center as its reference point, the engagement tends to become deviated toward the both ends. Hence it is desirable to adjust said ratio to be 1/L:4-(2l/L):1/L.

Figure 5:
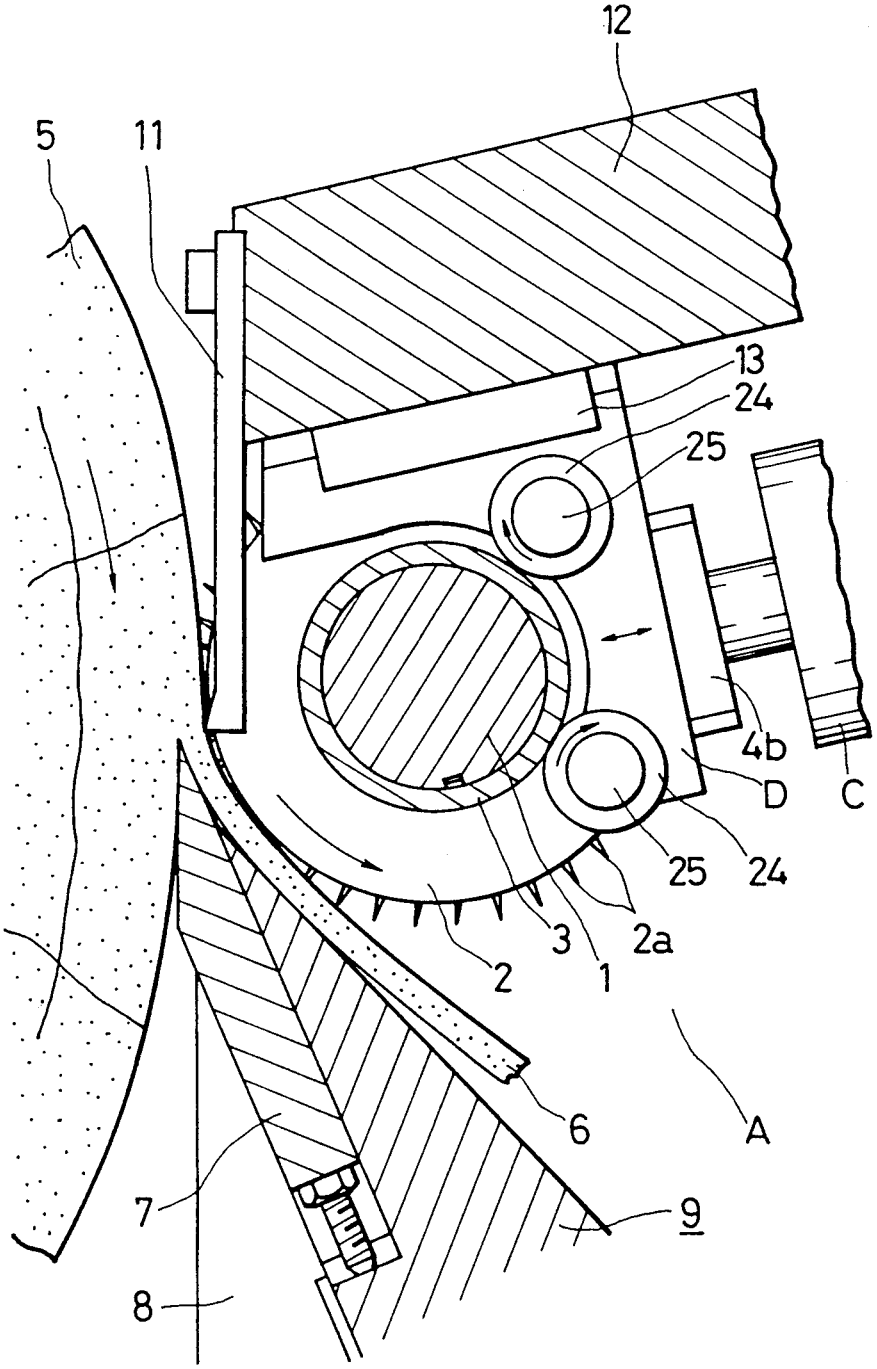
FIG. 5 is a sectional side view illustrating a peripheral driving veneer lathe employed in a second embodiment of the present invention.
Figure 6:
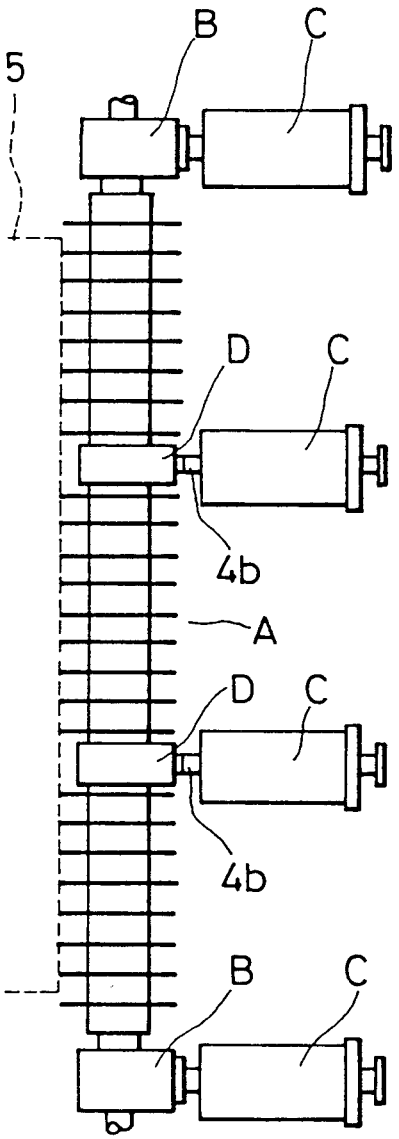
FIG. 6 is a plan view illustrating a third state in which pressure is applied to the driving roller.
Figure 7:
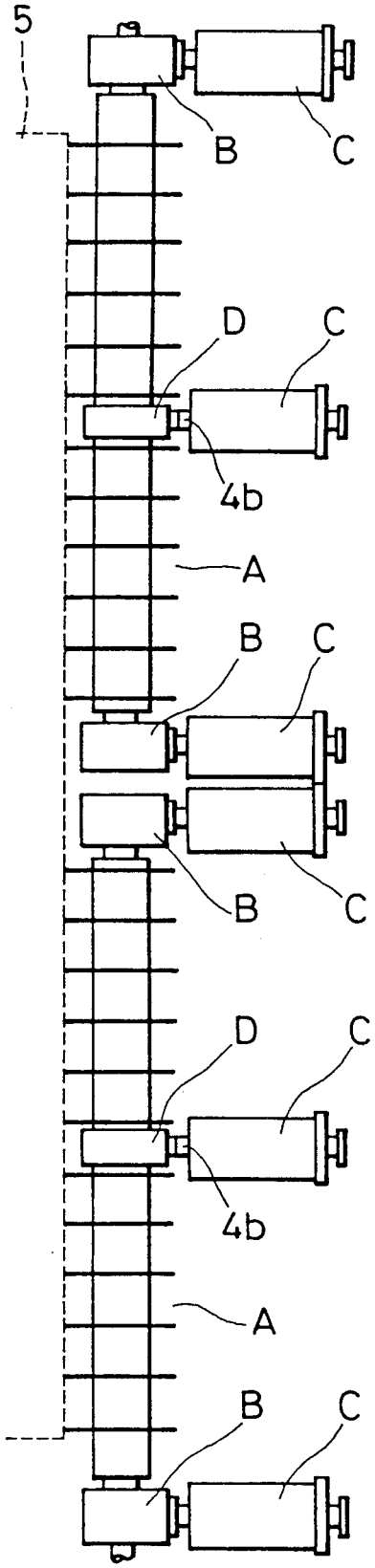
FIG. 7 is a plan view illustrating a fourth state in which pressure is applied to the driving roller.

In the peripheral driving veneer lathe shown in FIG. 5, there are provided in addition to said bearing B with built-in bearings, an appropriate number of external contact bearings D comprising a plurality of rotational members 24 with the bearings and other elements rotatably supported by supporting pins 25 as shown in the figure. Rotational members 24 are provided at positions where their peripheries are in external contact with the spacer ring 3 of the driving roller A, and connected to the pressure mechanisms C through bearing D and a narrow connecting pin *4b* for applying pressure. A bearing D of an external contact type, such as this, is quite convenient for applying pressure to the middle position of the driving roller A as illustrated in FIG. 6 and FIG. 7, for example. Furthermore, as illustrated in FIG. 6 and FIG. 7, if a structure is provided in such a manner that the driving roller A can be pressurized at comparatively many places, the pressure ratio can be adjusted at those plural places although the structure becomes slightly complicated. Hence this system is extremely convenient to use for preventing or reducing the local deviation of the engagement degree caused by the presence of concentrated knots.

As a matter of course, the structure of a peripheral driving veneer lathe embodying the present invention is not limited to the embodiments described above, and it is possible to make various modifications in designing each member thereof. Some of these design modifications are explained below.

First, the driving roller in each embodiment has an excellent transferability of the driving force by virtue of the spiky members mounted on its periphery, and since it is installed in a position to pierce a veneer, a tenderizing effect is exerted on the veneer. Furthermore, making the spiky member (driving member) replaceable brings about an advantage of an excellent economy over the one of integral structure. Nevertheless, a type with a friction intensifier, such as a rubber covering or knurling on the periphery, a type with a smooth periphery, or some other type which differs from the one described in the embodiment as to the ratio of width and the positional relationship between the part where it is in contact with a bolt and the other part can all be used as long as such type can supply at least part of the driving force required for lathing to the periphery of the bolt immediately before the lathing. There is no restriction, either, on the requirements for the spiky member, such as shape, number, and height.

Next, the type of the bearing for holding the driving roller in each embodiment can travel along the holder, and has an advantage that the relative position against both bolt and veneer can be displaced accurately. Nevertheless, a bearing capable of, for example, swinging substantially in the centripetal and centrifugal directions with a pivot member mounted on the holder as its center of swinging can also be adopted without hindrance in practice. It suffices if the bearing can hold or support a single or divided driving roller appropriately at plural places and guide it in the centripetal direction of the bolt when the pressure is applied by the pressure mechanism. There is no particular restriction, either, on the type of connecting member, such as a connecting pin, which may be used for connecting the pressure mechanism therewith.

Next, the type of the pressure mechanism for applying pressure to the driving roller in each embodiment employs a combination of a coil spring and hydraulic pressure, in which the initial deformation of the spring can be increased or decreased in accordance with an adjustment of hydraulic pressure, so that the pressure setting can be changed extremely easily. Another advantage is that occasional excess and deficiency of the engagement degree, caused by variations in the hardness of a bolt, is modified by immediate displacement of the driving roller due to the resilient deformation of the coil spring. However, the same advantages are available in embodiments using means other than hydraulic pressure to increase or decrease the initial deformation of the coil spring, such as a screw, or which use some other resilient member, such as rubber or plate spring, instead of the coil spring. Even a structure employing only hydraulic pressure, without any resilient member, and in which the pressure is set only by adjusting the hydraulic pressure, can serve the purpose of the invention as long as it has a configuration whereby a selected pressure is applied to the driving roller through the bearing and other elements. Also, particularly when the elements are arranged to apply pressure in many places, it may be desirable to suspend the application of pressure to some of those locations. The specific types of controlling equipment and devices, such as the pressure control valves for adjusting the hydraulic pressure, suitable for use with the invention will be apparent to one skilled in the art depending upon the particular application or embodiment at hand.

A pressure method according to the present invention as set forth above can prevent or reduce the deviation of the engagement degree of a driving roller with a bolt. As a result, the drawbacks associated with such deviations are reduced, including the diminished quality of a veneer, breaking of the bolt, and others.

What is claimed is:

1. A method for lathing a bolt, which comprises:
rotating a bolt to be lathed;
applying pressure to said bolt at a plurality of spaced locations along the length of said bolt; and
selectively and independently controlling the pressure applied to said bolt at one ore more of said spaced locations.

2. The method of claim 1, wherein the selective control of the pressure to be applied at said one or more locations is determined according to a desired ratio among said pressures applied at said plurality of locations.

3. The method of claim 1, wherein said selective control of the pressure to be applied at said one or more locations is determined according to the characteristics of the bolt to be lathed.

4. The method of claim 3, which further comprises automatically sensing the size of the bolt to selectively control said pressure.

5. The method of claim 3, which further comprises automatically sensing the hardness of the bolt to selectively control said pressure.

6. The method of claim 1, wherein the controlling step includes varying the pressure applied at said one or more locations while said bolt is lathed.

7. The method of claim 6, wherein said pressure applied at said one or more locations is varied continuously.

8. The method of claim 6, wherein said pressure, applied at said one or more locations is varied continuously while maintaining a constant ratio among the pressures applied at said plurality of locations.

9. The method of claim 1, wherein said bolt is rotated by a driving roller, and said pressure is applied at a plurality of spaced locations on said driving roller for transfer to said bolt.

10. The method of claim 9, wherein the pressure controlling step comprises applying a first pressure to said roller at each of said one or more locations.

11. The method of claim 10, wherein the pressure controlling step comprises applying a second pressure to said roller at each of said one or more locations, wherein said second pressure is applied in series with said first pressure.

12. A method for lathing a bolt, which comprises:
rotating a bolt to be lathed by peripheral engagement with a driving roller;
applying pressure to said driving roller at a plurality of spaced locations along the length of said bolt; and
selectively and independently controlling the pressure applied to said roller at one or more of said spaced locations.

13. The method of claim 12, wherein the selective control of the pressure to be applied at said one or more locations is determined according to a desired ratio among said pressure applied at said plurality of locations.

14. The method of claim 12, wherein the pressure applied at each of said plurality of locations is controlled selectively and independently.

15. The method of claim 12, wherein said pressure applying step comprises applying pressure at longitudinal ends of said roller.

16. The method of claim 15, wherein said pressure applying step further comprises applying pressure between said longitudinal ends of said roller.

17. A peripheral driving veneer lathe comprising:

means engageable with the periphery of a bolt to be lathed for rotating the bolt;

means for applying pressure to said bolt rotating means at a plurality of spaced locations along the length of said bolt; and means for selectively controlling said pressure applying means to independently control the pressure applied at one or more of said spaced locations.

18. The veneer lathe of claim 17, wherein said rotating means comprises a driving roller having a peripheral surface for engagement with said periphery of said bolt.

19. The veneer lathe of claim 18, wherein said driving roller is rotatably mounted within a housing, and said pressure applying means engages said housing.

20. The veneer lathe of claim 18, wherein said driving roller comprises a shaft and a driving member, and wherein said pressure applying means comprises bearings for rotatably engaging said shaft and transmitting force to said shaft from said pressure applying means.

21. The veneer lathe of claim 17, wherein each of said pressure applying means comprises hydraulic pressure means.

22. A peripheral driving veneer lathe, comprising:

means engageable with the periphery of a bolt to be lathed for rotating the bolt;

means for applying pressure to said bolt rotating means at a plurality of spaced locations, said pressure applying means comprising a resiliently deformable element, and means for causing deformation of said element; and means for selectively controlling said pressure applying means to independently control the pressure applied at one or more of said spaced locations.

23. The veneer lathe of claim 22, wherein said resiliently deformable element is a spring.

24. The veneer lathe of claim 22, wherein said means for causing deformation comprises hydraulic pressure means.

25. The veneer lathe of claim 22, wherein said means for causing deformation comprises a housing for said deformable element, and an expansion regulator operatively associated with said element housing for selectively varying the deformation of said deformable element within said element housing.

26. The veneer lathe of claim 25, wherein said means for causing deformation further comprises hydraulic pressure means, and a sliding member within said housing for transmitting force from said expansion regulator and said hydraulic pressure means to said deformable element.

27. A method for lathing a bolt, which comprises:

rotating a bolt to be lathed;

applying pressure to said bolt at a plurality of spaced locations;

selectively and independently controlling the pressure applied to said bolt at one or more of said spaced locations; and automatically sensing the hardness of the bolt to selectively control said pressure.

28. A method for lathing a bolt, which comprises:

rotating a bolt to be lathed by peripheral engagement with a driving roller;

applying pressure to said driving roller at a plurality of spaced locations, said spaced locations including longitudinal ends of said roller and at least one location between said longitudinal ends of said roller; and selectively and independently controlling the pressure applied to said roller at one or more of said spaced locations.

29. A peripheral driving veneer lathe, comprising:

means engageable with the periphery of a bolt to be lathed for rotating the bolt, comprising a driving roller having a peripheral surface for engagement with said periphery of said bolt, said driving roller comprising a shaft and a driving member;

means for applying pressure to said bolt at a plurality of spaced locations, said pressure applying means comprising bearings for rotatably engaging said shaft and transmitting force to said shaft from said pressure applying means, and said spaced locations including longitudinal ends of said roller and at least one location between said longitudinal ends of said roller; and means for selectively controlling said pressure applying means to independently control the pressure applied at one or more of said spaced locations.

* * * * *